US008807004B1

(12) United States Patent
Menefee, III

(10) Patent No.: US 8,807,004 B1
(45) Date of Patent: Aug. 19, 2014

(54) RECOIL ATTENUATED PAYLOAD LAUNCHER SYSTEM

(76) Inventor: James Y. Menefee, III, Macon, GA (US)

( * ) Notice: Subject to any disclaimer, the term of this patent is extended or adjusted under 35 U.S.C. 154(b) by 176 days.

(21) Appl. No.: 13/566,509

(22) Filed: Aug. 3, 2012

Related U.S. Application Data

(60) Provisional application No. 61/515,099, filed on Aug. 4, 2011.

(51) Int. Cl.
*F41G 5/06* (2006.01)
*F41A 1/02* (2006.01)
*F41A 1/08* (2006.01)

(52) U.S. Cl.
CPC .... *F41A 1/02* (2013.01); *F41A 1/08* (2013.01)
USPC ..... 89/1.7; 89/1.703; 42/105; 102/483

(58) Field of Classification Search
CPC ..... F41A 1/08
USPC ..... 89/1.7–1.706; 42/105; 102/483
See application file for complete search history.

(56) References Cited

U.S. PATENT DOCUMENTS

| | | | |
|---|---|---|---|
| 1,108,716 | A | 8/1914 | Davis |
| 1,565,036 | A | 12/1925 | Tank |
| 2,073,416 | A | 3/1937 | Finzi |
| 2,541,025 | A | 2/1951 | Bluford et al. |
| 2,651,972 | A | 9/1953 | Engelke |
| 2,789,471 | A | 4/1957 | Bluford et al. |
| 2,889,747 | A | 6/1959 | Kamp et al. |
| 2,949,061 | A | 8/1960 | Benditt et al. |
| 2,970,519 | A | 2/1961 | Musser et al. |
| 2,970,520 | A | 2/1961 | Grandy |
| 3,008,378 | A | 11/1961 | Musser |
| 3,008,412 | A | 11/1961 | Merdinyan |
| 3,026,775 | A | 3/1962 | Musser |
| 3,027,809 | A | 4/1962 | Musser |
| 3,144,808 | A | 8/1964 | Stapp et al. |
| 3,307,451 | A | 3/1967 | Ludwig et al. |
| 3,575,113 | A | 4/1971 | Ashbrook et al. |

(Continued)

FOREIGN PATENT DOCUMENTS

| | | | |
|---|---|---|---|
| CN | 1061658 | A | 6/1992 |
| EP | 0923700 | B1 | 2/2003 |

(Continued)

OTHER PUBLICATIONS

Field Manual No. 3-23.30, "Grenades and Pyrotechnic Signals," Chap. 4, Pyrotechnic Signals & Simulators, pp. 4-1-4-24, Headquarters, Dept. of the Army, Wash., DC, Oct. 15, 2009.

(Continued)

*Primary Examiner* — Michael David
(74) *Attorney, Agent, or Firm* — Sutherland Asbill & Brennan LLP

(57) ABSTRACT

This disclosure relates to launchers and launcher systems for discharging or launching payloads to downrange targets, and associated methods of using such launcher systems. This disclosure further provides methods for attenuating or reducing felt recoil such that relatively large weight payloads can be launched while the launcher is handheld or mounted in any manner. Examples of payloads that can be deployed with the disclosed launcher apparatus include chemical, biological, pyrotechnic, marker, tracer, signaling, non-lethal, anti-personnel, explosive, smoke, and similar payloads.

25 Claims, 6 Drawing Sheets

(56) References Cited

U.S. PATENT DOCUMENTS

| | | | | | |
|---|---|---|---|---|---|
| 3,619,924 | A | * | 11/1971 | Paine | 42/105 |
| 3,688,636 | A | * | 9/1972 | Spiess et al. | 89/1.8 |
| 3,721,194 | A | | 3/1973 | Weston, Jr. | |
| 3,745,876 | A | * | 7/1973 | Rocha | 89/1.7 |
| 3,960,052 | A | | 6/1976 | Smith et al. | |
| 3,980,139 | A | | 9/1976 | Kirk | |
| 4,010,688 | A | | 3/1977 | Smith et al. | |
| 4,091,709 | A | | 5/1978 | Spurk | |
| 4,132,148 | A | * | 1/1979 | Meistring et al. | 89/1.701 |
| 4,141,275 | A | | 2/1979 | Hollingsworth et al. | |
| 4,203,347 | A | * | 5/1980 | Pinson et al. | 89/1.816 |
| 4,208,948 | A | * | 6/1980 | Cobb | 89/1.706 |
| 4,404,887 | A | * | 9/1983 | Piesik | 89/1.816 |
| 4,457,233 | A | | 7/1984 | Hyde | |
| 4,473,964 | A | | 10/1984 | Straub et al. | |
| 4,682,952 | A | | 7/1987 | Forsman | |
| 4,753,152 | A | | 6/1988 | Baechler | |
| 4,964,469 | A | | 10/1990 | Smith | |
| 5,109,750 | A | | 5/1992 | Kayaian | |
| 5,429,034 | A | | 7/1995 | Badali et al. | |
| 5,631,441 | A | | 5/1997 | Briere et al. | |
| 5,837,919 | A | * | 11/1998 | Yagla et al. | 89/1.816 |
| 5,894,891 | A | | 4/1999 | Rosenstock et al. | |
| 6,012,531 | A | | 1/2000 | Ryan | |
| 6,044,746 | A | * | 4/2000 | Gendre et al. | 89/1.816 |
| 6,079,310 | A | * | 6/2000 | Yagla et al. | 89/1.816 |
| 6,145,440 | A | | 11/2000 | Franzen | |
| 6,286,408 | B1 | * | 9/2001 | Sanford et al. | 89/1.701 |
| 6,393,992 | B1 | | 5/2002 | Vasel et al. | |
| 6,470,805 | B1 | | 10/2002 | Woodall et al. | |
| 6,487,972 | B1 | | 12/2002 | Cook et al. | |
| 6,671,989 | B2 | * | 1/2004 | Vanek et al. | 42/18 |
| 6,725,941 | B2 | | 4/2004 | Edwards | |
| RE38,792 | E | | 9/2005 | Ishihara et al. | |
| 7,007,424 | B2 | * | 3/2006 | Vanek et al. | 42/18 |
| 7,325,350 | B1 | | 2/2008 | Grimes | |
| 7,430,825 | B2 | * | 10/2008 | Vanek et al. | 42/18 |
| 7,478,680 | B2 | | 1/2009 | Sridharan et al. | |
| 7,624,668 | B1 | * | 12/2009 | Sanford | 89/1.701 |
| 7,814,820 | B2 | | 10/2010 | Menefee | |
| 7,841,267 | B1 | * | 11/2010 | Sanford | 89/1.701 |
| 7,877,917 | B2 | | 2/2011 | Cinciu | |
| 7,987,790 | B1 | * | 8/2011 | Scarr | 102/503 |
| 8,327,768 | B2 | * | 12/2012 | Scarr | 102/503 |
| 8,371,280 | B2 | * | 2/2013 | Vanek | 124/16 |
| 8,511,232 | B2 | * | 8/2013 | Scarr | 102/503 |
| 8,661,983 | B1 | * | 3/2014 | Scarr | 102/503 |
| 2003/0010185 | A1 | | 1/2003 | O'Dwyer | |
| 2008/0178508 | A1 | | 7/2008 | Cinciu | |
| 2011/0017090 | A1 | | 1/2011 | Menefee, III | |
| 2012/0210857 | A1 | * | 8/2012 | Paulic | 89/5 |

FOREIGN PATENT DOCUMENTS

| | | | |
|---|---|---|---|
| FR | 1509166 | A | 1/1968 |
| GB | 624582 | A | 6/1949 |
| GB | 2149483 | A | 6/1985 |
| RU | 2103627 | C1 | 1/1998 |
| RU | 2170405 | C1 | 7/2001 |
| WO | 9855820 | A1 | 12/1998 |
| WO | 2006101410 | A1 | 9/2006 |
| WO | 2011142695 | A1 | 11/2011 |

OTHER PUBLICATIONS

PCT International Preliminary Report on Patentability and Written Opinion of the International Searching Authority for International Application No. PCT/US2012/049525 issued Feb. 4, 2014.

International Search Report and Written Opinion mailed Apr. 17, 2013 for PCT/US2012/049525.

* cited by examiner

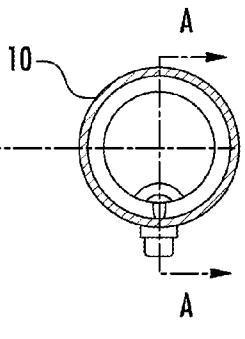
FIG. 4B
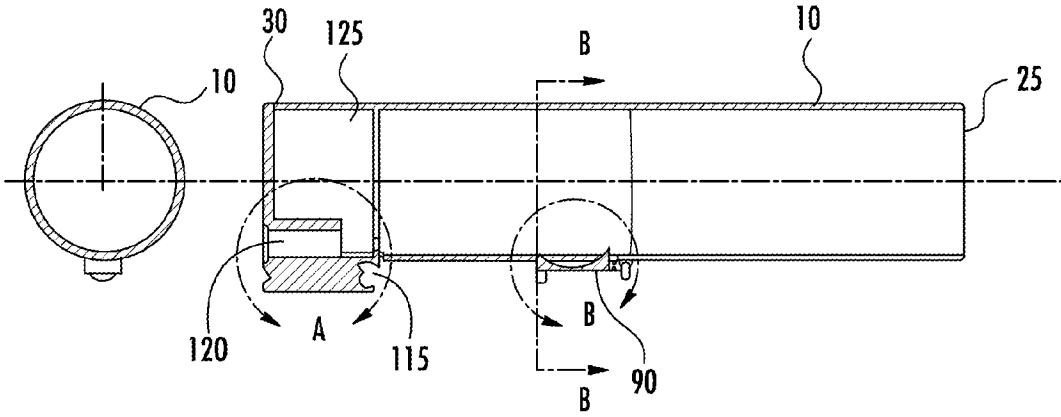
FIG. 4A
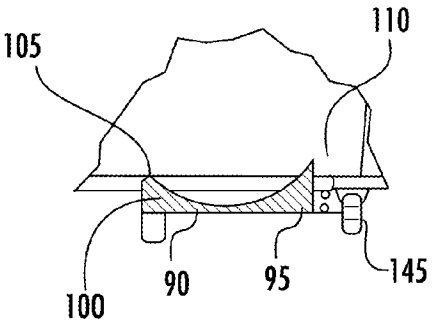
FIG. 4E
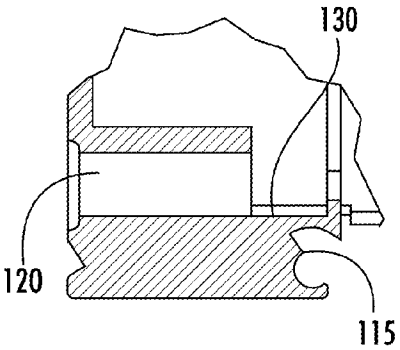
FIG. 4D
FIG. 4C

RECOIL ATTENUATED PAYLOAD LAUNCHER SYSTEM

CROSS REFERENCE TO RELATED APPLICATIONS

This application claims the benefit of U.S. Provisional Application No. 61/515,099, filed Aug. 4, 2011, the disclosure of which is incorporated herein by reference in its entirety.

TECHNICAL FIELD OF THE INVENTION

This disclosure relates to systems for discharging payloads, including chemical payloads, to downrange targets.

BACKGROUND OF THE INVENTION

Cartridge systems that contain a particular payload to be launched constitute extremely practical constructions for deploying almost any material or projectile downrange. Typical cartridge systems incorporate the desired payload, a propellant, and some priming composition all within a self-contained unit. While ammunition cartridges are prototypical of cartridge devices, useful cartridge systems have been designed to launch other payloads, such as chemical, pyrotechnic, marker, tracer, signaling, non-lethal projectiles, explosive, smoke, and other payloads such as anti-personnel, to exploit their specific functions.

Most cartridge systems require specialized launching devices that are designed for use with that particular cartridge, for example, 37 mm and 40 mm munitions launchers are commonly used for dispatching payloads such as rubber balls or chemical munitions. Even though these launchers use cartridges that are substantially larger than modern shotshell cartridges, their payload capacity is still limited. Moreover, simple design principles suggest that further increasing launcher and cartridge diameter to increase payload capacity has a practical upper limit, beyond which increased recoil would effectively prohibit using the high capacity launchers in a handheld or shoulder mounted configuration.

These features can be important factors in the decision to carry such launchers into hazardous situations, where it is usually extremely difficult to bring traditional tools into action. For example, extremely dangerous combat or battlefield situations, law enforcement operations, and riots, constitute dangerous environments in which portability and ease of operation of a chemical, fire suppression, signaling, and related cartridges and launchers may be important. Moreover, hand carried launching devices and their cartridges are limited in size due to one's ability to handle recoil, thereby limiting the overall amount of any particular payload that can be safely and accurately deployed.

Therefore, it would be helpful to discover and develop new launchers and systems for discharging payloads such as chemical payloads, powders, gels and the like, toward downrange targets, even at relatively long ranges. Launcher systems that could dispatch large weight and large volume payloads without the shooter experiencing excessive recoil due the payload size would be particularly desirable. Such a system would be very useful if it could be carried by an individual, readily deployed under combat or riot conditions, and fired in handheld or shoulder mounted configurations, because it incorporates some means of managing or attenuating recoil when launching a payload downrange.

SUMMARY OF THE INVENTION

The present disclosure addresses some of the desirable launcher system features described herein. For example, this disclosure relates to launchers and launcher systems that advance the capabilities of placing large payloads on target without the shooter experiencing excessive recoil due the payload size. This disclosure also relates to methods of managing, attenuating, or reducing felt recoil in a launcher system when deploying large payloads such as chemical payloads, powders, gels and the like, to downrange targets, including those at relatively long ranges (for example, 50 yards and beyond). Examples of payloads that can be launched with the disclosed system include chemical, biological, pyrotechnic, marker, tracer, signaling, non-lethal projectile, explosive, smoke, and the like. The launcher system is typically used in combination with a payload cartridge that is adapted for use with a specific payload and launcher system, as described herein. For example, the launcher systems can be used with a flare cartridge, a smoke flare cartridge, a signaling device cartridge, a chemical cartridge, a biological cartridge, a distraction device cartridge, a pyrotechnic launching device cartridge, a marking cartridge, an incendiary cartridge, a tracer cartridge, a non-lethal projectile cartridge, and the like.

Features of the launcher systems include their ability to be handheld or shoulder mounted, or otherwise carried and fired by an individual without being mounted. In one aspect, the launcher system incorporates a means of managing, distributing, and reducing felt recoil when launching any payload. When the system is described as "attenuating", "mitigating" or "reducing" recoil or a "recoil attenuated" or "recoil mitigated" payload launcher system, it is intended to reflect that recoil is distributed in a way to as to reduce felt recoil by the person firing the launcher, as understood by a person of ordinary skill in the art.

In one aspect, this disclosure provide a launcher system in which the system attenuates recoil or reduces felt recoil when launching a payload from a cartridge, the launcher system comprising:

a) a launcher tube having a muzzle and a breech and comprising a propulsion blank chamber at the breech;
b) a receiver attached to the launcher tube comprising a firing mechanism that mates with the propulsion blank chamber;
c) a primer-activated cartridge sized for axial movement within the launcher tube, the cartridge comprising a case, a primer, a propellant, and a payload;
d) a gas expansion-compression zone at the breech end of the launcher tube, in communication with the propulsion blank chamber;
e) a pressure relief means to vent gas from the gas expansion-compression zone; and
f) a primer activating means for activating the primer when the cartridge is moved a selected distance from breech to muzzle in the launcher tube.

One aspect of this disclosure is that it provides a method of managing recoil, that is, reducing felt recoil, when firing a primer activated cartridge, the method comprising:

a) providing a primer activated cartridge comprising a primer, a propellant, and a payload; and
b) activating the primer and the propellant while the primer activated cartridge is in forward motion.

In a further aspect and embodiment, this method of managing recoil when firing a primer activated cartridge can comprise:

a) providing a launcher system comprising:
   i) a launcher tube having a muzzle and a breech and comprising a propulsion blank chamber at the breech;
   ii) a receiver attached to the launcher tube comprising a firing mechanism that mates with the propulsion blank chamber;

iii) a primer-activated cartridge sized for axial movement within the launcher tube, the cartridge comprising a case, a primer, a propellant, and a payload;

iv) a gas expansion-compression zone at the breech end of the launcher tube, in communication with the propulsion blank chamber;

v) a pressure relief means to vent gas from the gas expansion-compression zone; and vi) a primer activating means for activating the primer when the cartridge is moved a selected distance from breech to muzzle in the launcher tube;

b) loading the propulsion blank chamber with a propulsion blank comprising a first stage propellant;

c) activating the propulsion blank to impart forward movement to the payload cartridge within the launcher tube from the expanding first stage propellant gases within the gas expansion-compression zone;

d) while the payload cartridge is in forward motion, activating the cartridge primer and the cartridge propellant, imparting rearward movement to the cartridge case; and e) selecting or adjusting the pressure relief means to vent gas from the gas expansion-compression zone at a rate that reduces felt recoil.

While the disclosed embodiments largely illustrate imparting forward movement to the payload cartridge from the propellant of a propulsion blank, any means of imparting forward movement to the payload cartridge can be used, such as springs, pneumatic pressure, and the like.

These and other aspects and embodiments are provided in the detailed description and appended claims, and certain embodiments are illustrated in the figures.

BRIEF DESCRIPTION OF THE FIGURES

FIG. 4 illustrates embodiments of the disclosed launcher system, including various views of the launcher tube, its components, and their mechanism of operation, including sectional views of the launcher tube, the payload cartridge within the launcher tube in its loaded configuration, the rocking firing pin, the propulsion blank chamber designed to accommodate a propulsion blank cartridge having a first stage propellant, and the propulsion blank chamber in gaseous communication with the gas expansion-compression zone at the aft end of the launcher tube.

DETAILED DESCRIPTION OF THE INVENTION

Figure 1:
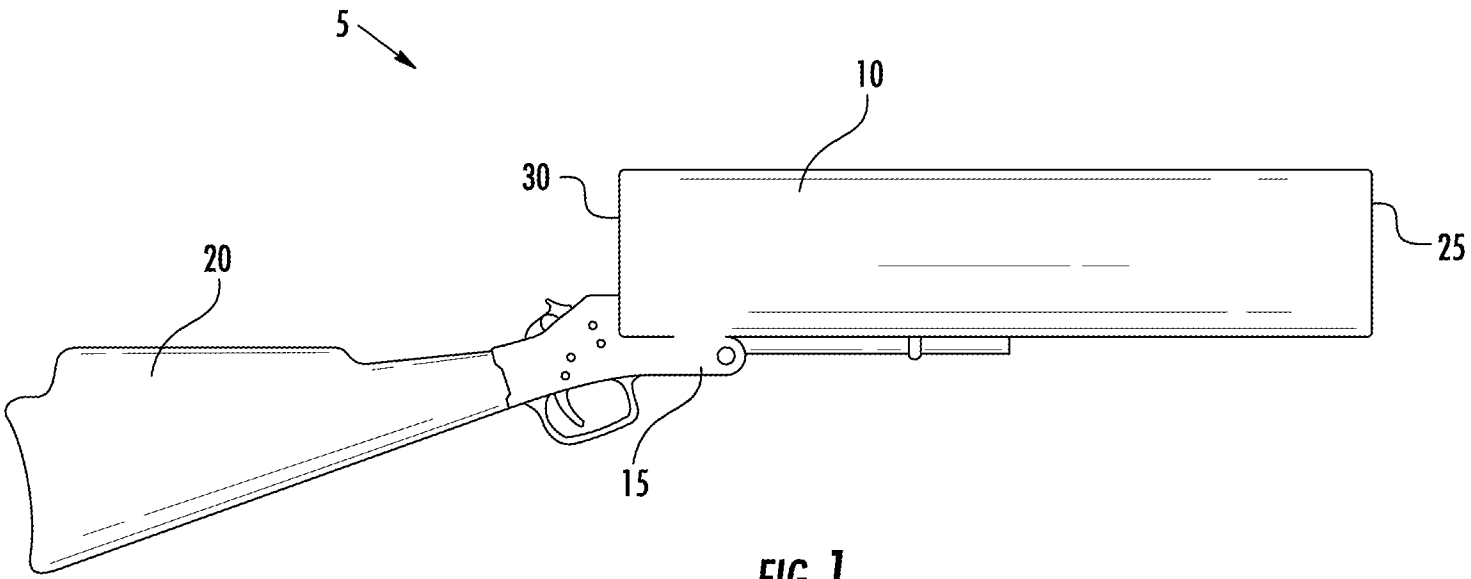
FIG. 1 illustrates a side elevation view of an embodiment of the launcher system of this disclosure that includes the relatively large diameter launcher tube mounted to a break action, single shot shotgun receiver, the receiver including a stock for shoulder-mounting the launcher.
Figure 2A:
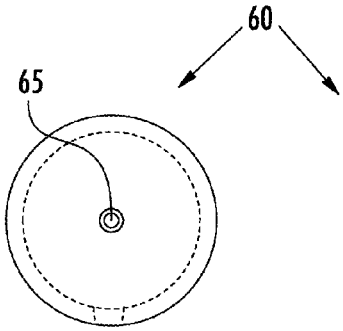
FIG. 2 illustrates an embodiment of the launcher system of this disclosure, specifically, side and end views of a payload cartridge according to this disclosure, the cartridge having a case or hull, the case including a rim with a diameter allowing axial movement of the cartridge within the launcher barrel, stand-offs for axially centering the cartridge within the launcher barrel, a primer, and a cap that can be breached upon igniting the primer and propellant.
Figure 2B:
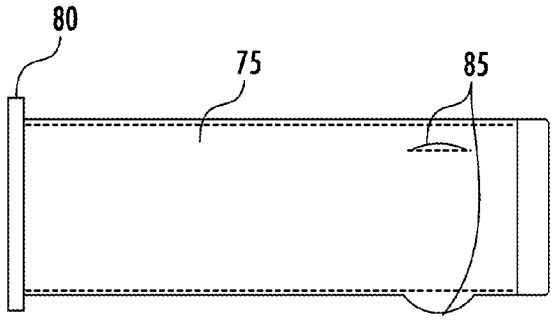
Figure 2C:
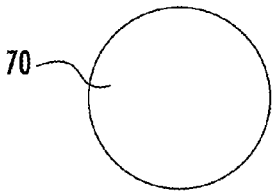
Figure 2D:
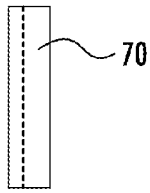

Aspects of this disclosure relate to launchers and launcher systems for discharging or deploying payloads such as chemical payloads to downrange targets, including those at relatively long ranges (for example, 50 yards and beyond). Moreover, this disclosure provides methods of mitigating or reducing felt recoil that use simple physical principles and that allow the deployment of large payloads with a launcher that can be handheld or shoulder mounted. Reference in this disclosure of a "shoulder mounted" launcher is merely illustrative and unless the context suggests otherwise, does not require the launcher to include a stock with a butt for shoulder mounting.

The versatility of the disclosed method and the launchers are exemplified in the types of payloads that can be launched with the disclosed system, which include chemical, powder, gel, fire suppression, pyrotechnic, marker, tracer, signaling, non-lethal projectile, frangible, anti-personnel, explosive, smoke, incendiary, biological, heat insulating, anti-chemical warfare, anti-biological warfare, a liquid-containing payload, a powder-containing payload, or a gel-containing payload. Examples of suitable non-lethal payloads include, but are not limited to, rubber projectiles, bean bags, rubber batons, tear gas, oleoresin capsicum, and the like. Examples of suitable anti-personnel payloads include, but are not limited to, buckshot, explosive fragmentation projectiles, caltrops, flechettes, and the like. Thus, the launcher system can be used in combination with a payload cartridge that is adapted for use with the particular launcher system, as described herein, and the cartridge can be selected from, among other things, a flare cartridge, a smoke flare cartridge, a signaling device cartridge, an illumination cartridge, a chemical cartridge, a biological cartridge, a distraction device cartridge, a pyrotechnic launching device cartridge, an anti-personnel cartridge, a marking cartridge, an incendiary cartridge, a tracer cartridge, a non-lethal cartridge, and the like. For example, any cartridge could be designed for use with corresponding launchers and propulsion blanks that are sized for use with that specific cartridge only.

In one aspect or embodiment, the disclosed launcher system is adapted for use in a shoulder mounted configuration, although the disclosed and claimed mechanism is not limited thereto. Further, this disclosure provides a mechanism and method employing two separate cartridges or propulsion means to limit the recoil of a payload launcher, such that relatively large payloads can be launched using shoulder fired or even hand held launchers. One aspect includes a launcher that uses a first stage propulsion blank and a separate payload cartridge that itself contains a second stage propellant and primer along with the payload. For example, in one embodiment, a shoulder mounted launcher is provided that employs a propulsion blank which, when fired, thrusts a separate payload cartridge a given distance within the barrel of the launcher, at which point the primer and second stage propellant of the payload cartridge are ignited. Firing the second stage propellant occurs just fractions of a second after firing the first stage propellant, and the second stage firing serves to both launch the payload downrange and thrust the cartridge hull or case in a rearward direction against an expansion of gases, thereby providing a recoil dampening function.

While not intending to be bound by theory, it is thought that firing the first stage propulsion blank essentially drives the payload cartridge and its built in propellant and payload mechanism forward. The first stage propulsion blank can be a primed hull or a primed hull that includes an amount of propellant, typically smaller than a full propellant charge. A very short time later, while the relatively heavy payload cartridge is moving forward, the firing pin mechanism fires the second stage payload cartridge, which launches the payload. After firing, the payload cartridge hull recoils to the rear after overcoming the momentum derived from forward movement, which serves to minimize or effectively cancel out much of the recoil force. In this manner, relatively large payloads can be launched at moderate velocities, without undue recoil, which otherwise would relegate the launcher to some mounted platform unsuitable for shoulder fired devices. For example, most payloads are expected to be launched with muzzle velocities from about 50 fps (feet-per-second) to about 500 fps, typically from about 75 fps to about 400 fps, although the device is adaptable to sending payloads downrange at lower or higher velocities. Typically, though not necessarily, the disclosed embodiments are expected to launch substantial payloads from about 50 yards to about 500 yards or more.

Thus, one aspect of this disclosure provides a payload delivery system that is a two-stage system, with each stage comprising a different type of cartridge. The first stage cartridge can constitute a specially designed blank-type propulsion cartridge, which fits into a chamber designed to accept such propulsion cartridges. The first stage cartridge can be, for example, a shotshell type cartridge, but typically is one having a shorter length than a standard 2¾ inch shotshell, such that commonly available or standard shotshells cannot be inadvertently chambered in the launcher. This first stage cartridge can include a primer with or without additional propellant, as the size and weight of the payload cartridge to be thrust down the barrel would dictate. The second stage cartridge typically comprises a primer, a propellant, and a payload such as a chemical payload, and can have a diameter substantially larger than a standard 37 mm or 40 mm launcher so as to encompass a significantly larger payload. Because the area of a circular cross section increases as the square of its radius, doubling the radius of a payload cartridge quadruples its volume, when the payload compartment within the cartridge has the same length. This ability to launch large diameter payloads provides the tremendous utility of the disclosed launcher in sending large volumes of material to a downrange target, using a simple device that is portable and can be readily operated by a single individual.

The launcher system mechanism is adapted for firing the second stage primer and propellant as the payload cartridge moves a specific distance along a length inside the launcher barrel, which occurs within an extremely short time from firing the first stage propulsion blank. The second stage payload cartridge has a suitable diameter such that it fits into the large diameter launcher tube with sufficient space to just accommodate rapid axial movement within the launcher barrel, but not so much space that a substantial portion of the expanding gases can escape around and forward of the advancing payload cartridge. Further, the second stage payload cartridge can be rimmed. In various aspects, for example, the rim allows for retention of the payload cartridge within the launcher barrel until such time as the payload is ready to be launched. Moreover, the rim further activates a swinging or rocking firing pin, situated a portion of the length down the launcher tube and having a suitable shape and orientation to engage the payload cartridge primer as the payload cartridge rim contacts the activating arm of the rocking firing pin. The rimmed payload cartridge contains its own primer and propellant, along with the desired payload, and therefore constitutes the structure from which the payload is launched. Striking the payload cartridge primer with the rocking firing pin ignites the primer and propellant and sends the selected payload to the downrange target. In this manner, the rimmed payload cartridge functions as its own barrel and chamber from which the specialized payloads disclosed herein can be launched at relatively low velocities.

Accordingly, this disclosure provides a payload launcher system device particularly suited for use in the dangerous environments of combat or law enforcement situations, due to the device's light weight, portability, ease of operation, and ability to rapidly cover an area—including personnel within that area—with a chemical payload such as fire suppression chemicals, anti-chemical warfare substances, or anti-biological warfare substances.

Thus, in one aspect and embodiment, there is provided a launcher system in which the system reduces felt recoil when launching a payload from a cartridge, the launcher system comprising:

a) a launcher tube having a muzzle and a breech and comprising a propulsion blank chamber at the breech;
b) a receiver attached to the launcher tube comprising a firing mechanism that mates with the propulsion blank chamber;
c) a primer-activated cartridge sized for axial movement within the launcher tube, the cartridge comprising a case, a primer, a propellant, and a payload;
d) a gas expansion-compression zone at the breech end of the launcher tube, in communication with the propulsion blank chamber;
e) a pressure relief means to vent gas from the gas expansion-compression zone; and
f) a primer activating means for activating the primer when the cartridge is moved a selected distance from breech to muzzle in the launcher tube.

In a further aspect and embodiment, this method of managing recoil when firing a primer activated cartridge can comprise:

a) providing the launcher system described immediately above;
b) loading the propulsion blank chamber with a propulsion blank comprising a first stage propellant;
c) activating the propulsion blank to impart forward movement to the payload cartridge within the launcher tube from the expanding first stage propellant gases within the gas expansion-compression zone;
d) while the payload cartridge is in forward motion, activating the cartridge primer and the cartridge propellant, imparting rearward movement to the cartridge case; and
e) selecting or adjusting the pressure relief means to vent gas from the gas expansion-compression zone at a rate that reduces felt recoil.

Again, while the disclosed launcher embodiments largely illustrate imparting forward movement to the payload cartridge from the propellant of a propulsion blank, any means of imparting forward movement to the payload cartridge can be used. Examples include but are not limited to devices and methods such as springs, pneumatic pressure using any compressed gas, and the like.

Thus, as illustrated herein, one aspect of this disclosure is that it provides a method of managing recoil, that is, reducing felt recoil, when firing a primer activated cartridge, the method comprising:

a) providing a primer activated cartridge comprising a primer, a propellant, and a payload; and b) activating the primer and the propellant while the primer activated cartridge is in forward motion.

The primer activating means of the launcher system can be a firing pin or an electronic primer system. Electronic priming systems are known in the art, examples of which include those disclosed in U.S. Pat. No. 6,487,972 to Cook, et al., and related firearm actuating means for firing electrically activated primers and ammunition are disclosed in RE38,792 to Danner. Therefore, incorporating electrically actuating means for activating the payload cartridge primer of this disclosure is envisioned in this disclosure. Various electrically conductive portions of the cartridge and primer are therefore also envisioned, such as, for example, the cartridge rim that can contact and electrical contact as the desired distance from the breech during its forward movement, and thereby activate electronically the cartridge primer.

When the primer activating means is a firing pin, in one aspect, the firing pin can be an elongated rocking firing pin situated in a longitudinal cutout in the side wall of the launcher tube, the rocking firing pin comprising:

a) a forward end that is pivotally attached to the side wall of the launcher tube within the cutout to allow movement of the rocking firing pin within the plane containing the launcher tube axis, the forward end comprising an extended lever that protrudes into the interior of the launcher tube; and b) an unattached aft end that comprises a firing pin portion oriented to strike a primer in the center of the launcher tube.

In embodiments, the cartridge can comprise a rim at the base of the hull or case. Further, the launcher tube can further comprise at least one detent situated at the breech end of the launcher tube, extending into the interior thereof a sufficient distance to detachably secure the cartridge rim. For example, each detent can be retractably attached to the side wall of the launcher tube. Such a means secures the cartridge at the breech end of the launcher tube prior to firing.

In a further aspect, the pressure relief means in the launcher system according to this disclosure can comprise at least one pressure conduit, a baffle or series of baffles, or at least one pressure relief valve, or some combination thereof. For example, the step of selecting or adjusting the pressure relief means to vent gas from the gas expansion-compression zone can be carried out using a pressure conduit, pressure relief baffles, and the like that can be selected or adjusted according to size and shape to vent gas at a rate that reduces felt recoil. In other embodiments, the step of selecting or adjusting the pressure relief means to vent gas from the gas expansion-compression zone can be carried out using a pressure relief valve that is selected or adjusted according to pressure and size to vent gas at a rate that reduces felt recoil.

The figures generally show shotgun style receivers, which are merely illustrative of the receiver types. It is not necessary that the receiver be a shotgun style, and it is not required that the receiver include a stock or any particular stock style, other than generally including some means of holding the launcher. For example, the receiver can be a shotgun style receiver comprising a stock for shoulder mounting, or comprising a pistol grip, or any other type of grip. The recoil mitigation system of this disclosure allows for virtually any type of grip to be used, while still allowing the deployment of large payloads to downrange targets. In another aspect, the receiver can further comprise any type of manual safety if desired, such as a half cock position on a hammer, a cross bolt safety, or any other type of manual safety.

The various aspects and embodiments of the disclosed device are illustrated in the figures that are a part of the disclosure of this application.

Referring to FIG. 1, one particular embodiment of the launcher system, namely, a shoulder mounted payload launcher system 5 of this disclosure is illustrated. This system can include, for example, a relatively large diameter launcher tube 10 mounted to a break action, single shot shotgun receiver 15 with stock 20. Launcher tube 10 includes a forward ("fore" or muzzle) end 25 and a rearward or breech ("aft") end 30, the launcher tube comprising the mechanism for two-stage propulsion of the desired payload. The launcher tube can be several inches in diameter. As will be seen, the break action receiver is broken to load the propulsion blank at the breech, while the payload cartridge is muzzle loaded. Launcher tube 10 can be various lengths and have different bore diameters, including as large as 60-100 mm or more, yet function in a manner that reduces felt recoil sufficiently to allow the launcher to be hand carried and operated or and operated while shoulder mounted or mounted in any fashion. A handguard 32 forward of the trigger and trigger guard can also be included if desired, but such a feature is not shown in this embodiment, so the rocking firing pin assembly and the rod and pivot safety mechanism can be viewed in this particular embodiment. As indicated in this disclosure, the firing pin assembly is one method of actuating a primer of the payload cartridge, but other methods such as electronic primers can also be used.

Referring to the illustrations of FIG. 2, in general terms, the payload cartridge 60 is reminiscent of a very large shotshell in that it comprises a primer 65, a cap 70 or alternatively some kind of crimping or sealing that can be breached upon igniting the propellant in the payload cartridge, a case or hull 75, and a rim 80. As illustrated, the payload cartridge 60 typically includes a sufficient number of fins 85, typically at least three, or similar structures that function as spacers or stand-offs to keep the fore end of the payload cartridge axially centered within the launcher barrel. Therefore, the aft end of the cartridge is centered by way of the rim that fits the diameter of the launcher tube, and the fore end of the cartridge is centered by way of the fins 85, the circumferential diameter of which fits the diameter of the launcher tube. The fin or stand-off feature is employed to center the payload cartridge and to allows the middle portion of the cartridge in its loaded configuration to sit atop or adjacent a "rocking" firing pin that will be engaged by the rim as it is propelled past its location in the launcher tube wall. It generally is not required that the payload cartridge be rotationally oriented as it is loaded within the launcher tube, because the payload cartridge fins can not interfere with the rocking firing pin. It is only required that the aft end of the cartridge be muzzle loaded first.

The fins 85 of FIG. 2 are simply one embodiment or method of centered the payload cartridge 60 in the launcher tube 10, and other methods of centering the cartridge are possible. For example, one or more rings or other types of spacers can be used to stand-off or center the cartridge at its fore end. One benefit of one or more rings is the additional obturating function they would provide in sealing gases from the propulsion blank and imparting forward movement to the payload cartridge. In addition, depending on the particular method by which the payload cartridge primer is to be actuated, it is also possible to use other spacers besides a rim at the aft end of the payload cartridge. However, to the extent that the rim provides a triggering means to actuate the payload cartridge primer, the design of the rim or other spacers besides a rim at the aft end of the payload cartridge should be taken into account.

Figure 3A:
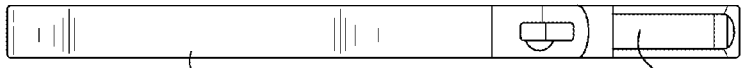
FIG. 3 illustrates an embodiment of the launcher system of this disclosure, specifically, side and bottom views of a break action, single shot shotgun receiver, the receiver including a stock for shoulder-mounting the launcher and optional accessories such as optional storage slots for propulsion blanks.
Figure 3B:
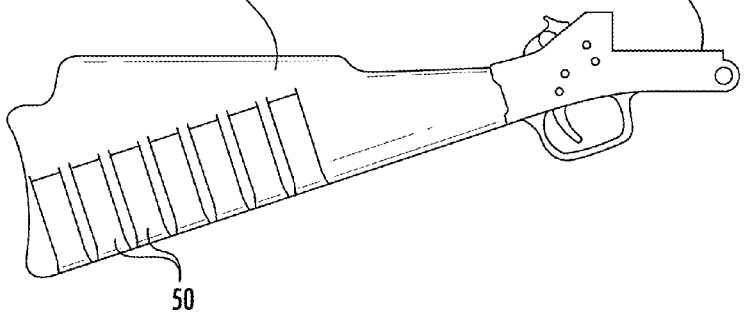
Figure 3C:
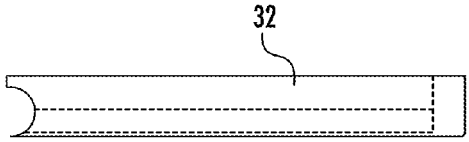
Figure 5A:
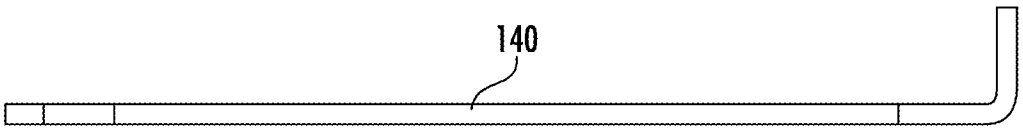
FIG. 5 illustrates a further aspect and embodiment of the disclosed launcher system, namely a simple rod and pivot safety mechanism that is designed to operate when the launcher is broken open using a standard latch on the receiver, which prevents the firing pin from contacting the primer when the action is opened, by lowering the pivot point at the forward end of the rocking firing pin away from the launcher tube.
Figure 5B:
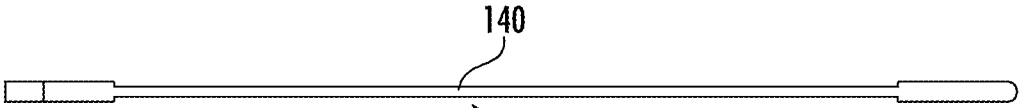
Figure 5C:
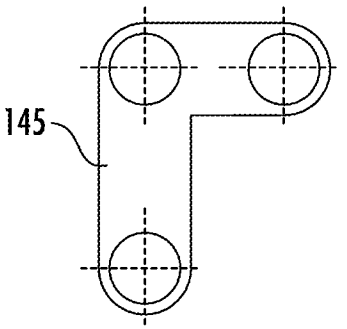
Figure 5D:
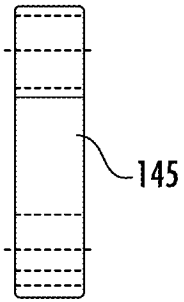

As illustrated in the embodiment of FIG. 3, the firing component to ignite the first stage propulsion blank, in other words, the blank propulsion cartridge, can be a simple shotgun receiver, such as the standard single shot receiver illustrated in FIG. 3. This device is not limited to any particular gauge, but the commonality of a 12 gauge receiver makes it an attractive base on which to mount the launcher tube 10. Illustrated in FIGS. 3A and 3B are two views of the break action single shot shotgun receiver 15, to which the launcher tube is connected, and also illustrates optional storage slots 50 for propulsion blanks 55. The aft end of the launcher tube that is configured to receive the propulsion blanks 55 is designed in a similar manner as the breech of a shotgun that is the same gauge as the shotgun receiver 15. That is, the break open action, any extractor or ejector device that is used to extract of eject the spent propulsion blank, any safety devices, and the like are incorporated as desired into the launcher tube aft end 30.

FIG. 4 illustrates various views of the launcher tube, its components, and their mechanism of operation. For example, FIG. 4A provides a lateral (as opposed to axial) sectional view of the launcher tube 10, corresponding to section A-A shown in the axial view into the launcher tube shown in FIG. 4B. The lateral sectional view of FIG. 4A is further illustrated by the B-B sectional view of FIG. 4C. The portions of FIG. 4A marked as "A" and "B" are shown in detail in FIGS. 4D and 4E, respectively. FIG. 4A also shows the payload cartridge 60 in its loaded configuration in the launcher tube 10, as it would occur prior to firing. The location of a rocking firing pin 90 is shown in FIGS. 4A and 4E. The rocking firing pin 90 is pivotally attached at its forward end 95 within a cutout of the corresponding shape in the wall of the launcher tube. The aft end 100 of the rocking firing pin 90 comprises the firing pin portion that contacts the primer 105 of the moving payload cartridge 60. The ignition of the payload cartridge primer is initiated by the forward movement of the payload cartridge itself, when the cartridge rim 80 contacts the extended lever 110 of the rocking firing pin located at its forward end 95. This extended lever 110 protrudes into the chamber of the launching tube through a cutout in the launcher tube wall, and rocking is permitted by a pivot point that is perpendicular to the launching tube axis, and which pivotally attaches this "secondary" firing pin to the launcher tube wall. On contact of the forward moving payload cartridge rim with the extended lever 110 of the rocking firing pin, rapid angular displacement of the aft end of the pin occurs, and the aft firing pin portion contacts the payload cartridge primer to ignite the propellant and launch the payload downrange.

FIG. 4A-4E also illustrate how the launcher tube 10 is designed to fit the receiver 15 with the barrel lug 115 which is matched to fit the receiver 15 which can include a corresponding locking lug 117 just like the barrel lug and locking lug on a shotgun barrel and receiver, respectively. FIG. 4 also shows the chamber 120, for example, a 12 gauge chamber, at the aft end 30 of the launcher tube, which is shown adjacent one wall of the launcher tube in order to mate with the firing pin mechanism of the standard shotgun receiver 15 for igniting the propulsion blank. The chamber 120 allows the hot expanding gases of the propulsion blank to enter the aft portion of the launcher tube in a gas expansion-compression zone 125 and accelerate the payload cartridge down the launcher tube. FIG. 4 further illustrates the pressure relief port 130 which, following the launching of the payload cartridge, allows at least a portion of the gases being compressed in the gas expansion-compression zone 125 to be vented outside the aft portion of the launcher tube, as the emptying payload cartridge is thrust rearward. Also shown are the rocking firing pin 90 with its firing pin portion 105 at the aft end 100 and the extended lever 110 at the forward end 95. Because of the cushioning effect that occurs on thrusting the payload cartridge rearward when activated, which is provided by the gas in the gas expansion-compression zone 125, this zone functions as both a gas expansion zone when firing the propulsion blank and a gas compression zone when firing the payload cartridge.

The chamber 120 of the launcher tube 10 typically is sized to only allow for a very short blank first stage propellant or propulsion blank cartridge 55 to be chambered. For example, the blank first stage propulsion blank 55 typically is about 1¾ inches in length, significantly shorter than the standard 2¾ inch shotshells, and even shorter than commercially available, low pressure cartridges designed for older shotguns that are typically 2½ inches or even 2 inches length. This design prevents standard shotshells of any length from being inadvertently chambered in the launcher. Alternatively, special, non standard length and/or non standard gauge blanks can be manufactured and fitted to the launcher, for increased safety or to otherwise limit operation of the launcher system to use only with the supplied propulsion blanks.

Also illustrated in FIGS. 4A-4E are the gas expansion-compression zone 125 at the aft end 30 of the launcher tube and a pressure relief port 130. The pressure relief port 130 functions to provide a gas communication means between the gas expansion-compression zone 125 of the launcher tube 10 and the air outside the launcher tube, to vent the gas expansion-compression zone 125 to the outside. In this manner, pressure relief port 130 functions to provide a means to release gas pressure upon launching the payload cartridge, as the payload cartridge recoils to the rear after overcoming the momentum derived from its forward movement. This rearward movement compresses gases within the gas expansion-compression zone 125, which can be vented to any extent desired by the size and shape or the pressure relief port 130. This sequence serves to minimize or effectively cancel out much of the recoil upon launching a payload.

In alternative embodiments and other aspects, the first stage launching mechanism can comprise means of providing the first stage of propulsion, other than a propulsion blank designed to fit a chamber. For example, first stage propulsion can be provided by a compressed gas, such as would be available with a gas cylinder, including a $CO_2$ (carbon dioxide) cylinder or cartridge. In this aspect, a cartridge valve that meters a first stage blast of gas can provide propulsion, or a gas cartridge that can be pierced by penetrating contact with a sharp piercing structure can provide a first stage blast of gas. Any variety of means to provide a first stage launching mechanism are envisioned by this disclosure.

In some embodiments, but not illustrated in the figures, one or more detents can be situated at the aft end of the launcher tube 10, which is designed to retain the unfired payload cartridge in the launcher tube such that is does not fall out the muzzle. The detents are released by any suitable mechanism or means prior to the actual firing of the propulsion blank to initiate the launch sequence. For example, one such detent can be situated on the top of the aft end of the launcher tube, when held in the firing position, and can be pivotally attached such that an upward movement will disengage the detent cause a rear sight to extend, by which the launcher can be aimed.

FIG. 5 illustrates a simple rod and pivot safety mechanism that is specific for when a rocking firing pin mechanism is used to ignite the primer in the payload cartridge. Thus, FIG. 5 illustrates a simple rod and pivot safety mechanism 135 that is designed to operate when the launcher is broken open using a standard latch on the receiver. The rod and pivot safety mechanism functions by connecting one end of an axially movable rod 140 to the receiver and the other end to the forward end 95 of the rocking firing pin 90 by way of an L-shaped pivot 145. Opening the break action receiver pushes the pivot 145 forward, which lowers the pivot point at the forward end 95 of the rocking firing pin away from the launcher tube, such that there is no possibility that the extended portion 110 of the rocking firing pin can be contacted by a payload cartridge rim 80 and cause it to swing into the inner portion of the launcher tube. FIG. 5A shows two view of the rod portion 140 of the rod and pivot safety mechanism 135, and FIGS. 5B and 5C illustrate two views of the pivot portion 145 of the rod and pivot safety mechanism 135. The rod and pivot safety mechanism can be seen in FIG. 1A attached along the underside of the launcher tube, in FIG. 1B, which illustrates the underside of the launcher and shows the attachment points of the rod portion 140, and in FIG. 4E at the forward end of the rocking firing pin. This simple rod and pivot safety mechanism 135 of FIG. 5 would not be required when using, for example, an electronic priming method to ignite the primer in the payload cartridge.

Figure 6:
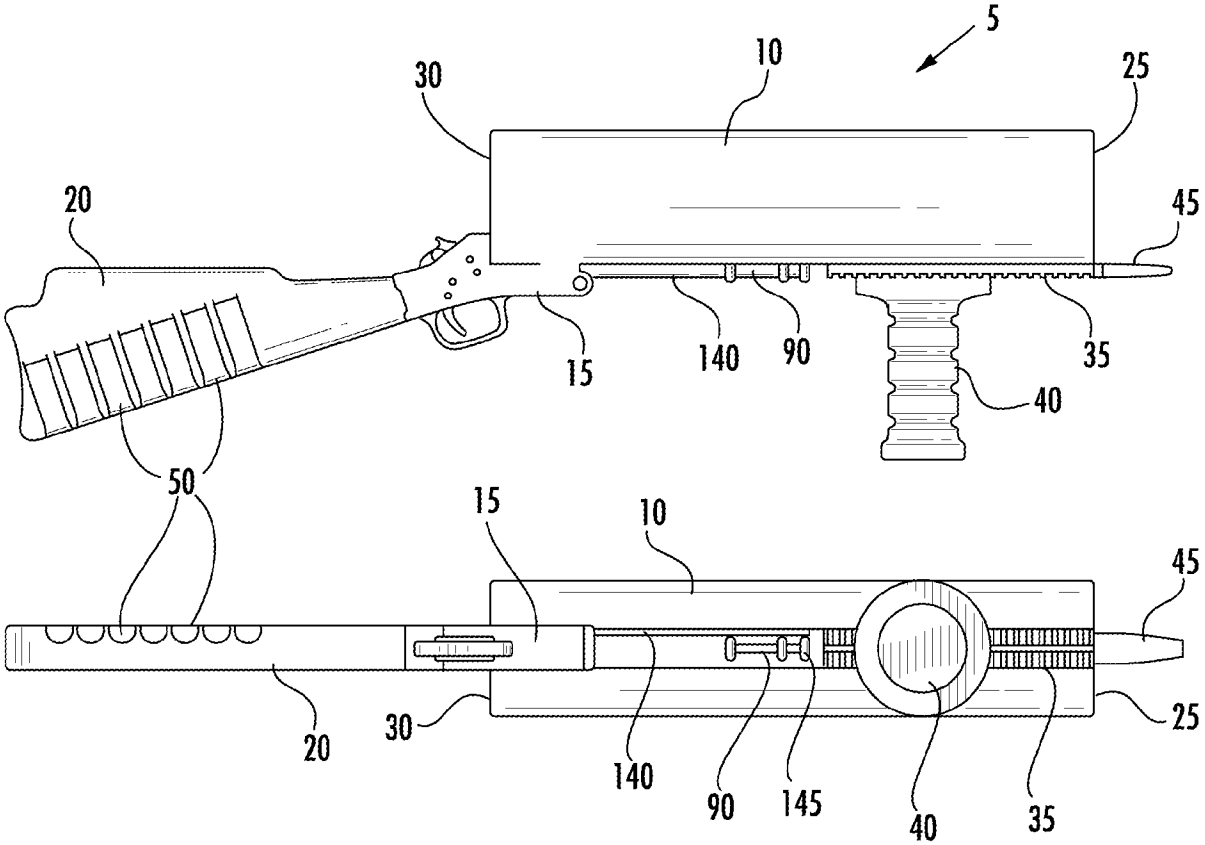
FIG. 6 illustrates side and bottom elevation views of a particular embodiment of the launcher system of this disclosure, illustrating the launcher tube mounted to a break action, single shot shotgun receiver, and also illustrating optional components and accessories that can be used with the launcher.

FIG. 6 illustrates one particular embodiment of the launcher system, namely, a shoulder mounted payload launcher system 5 that includes various optional components and accessories. For example, FIG. 6 illustrates the payload launcher system with the launcher tube 10 mounted to a break action, single shot shotgun receiver 15 with stock 20. The launcher tube 10 is illustrated fitted with an accessory rail 35, a vertical fore grip 40, and a probe or breaching tool 45. Further, any type of sights or sighting device, ranging means, and the like can also be included. The common break action, single shot shotgun receiver 15 to which the launcher tube is connected, can also comprise accessory components, such as the optional storage slots 50 for propulsion blanks 55 as shown in the FIG. 6 embodiment.

It is seen that the launcher tube 10 itself serves as a type of chamber for several inches from the aft end nearer the blank cartridge, which is designed to utilize the rimmed, second stage payload cartridge 60, shown with its cap 70 in FIG. 2. The rimmed, second stage payload cartridge functions as a cartridge that includes its own primer, propellant, payload, and accompanying components, but also serves as both a barrel and chamber for the relatively low pressure and low velocity (For example, about 100 fps to about 300 fps muzzle payload speeds) of payload. By way of example, suitable payloads that can be launched include chemicals such as fire suppression chemicals, anti-chemical warfare substances, and/or anti-biological warfare substances, whether in powder, liquid, or gel form. This two-stage mechanism includes an initial propulsion step followed by igniting the main payload cartridge, which allows the payload cartridge hull to recoil to the rear after overcoming the momentum of the forward movement of the heavy payload cartridge. These features minimize the recoil force associated with launching such a large payload. Thus, the momentum of the relatively heavy payload cartridge being moved forward by the propulsion of the blank charge negates, offsets, or attenuates much of the resulting recoil generated by igniting the payload cartridge itself. As the payload cartridge moves rearward it can move back into the tighter tolerance "slip fit" area where it was situated in the loaded configuration. The rearward movement is moderated by venting the gases behind the payload cartridge at the appropriate rate as they begin to compress within the gas expansion-compression zone. The pressure relief means can be selected or adjusted to vent the gases as the desired rate so that the hull does not slam into the breech end with excessive force, and the initial forward speed and momentum of the heavy payload cartridge can also be selected to offset or attenuate any rearward movement of the cartridge hull. For example, gas expansion-compression zone can include at least one pressure relief port or valve that can be selected or adjusted by size, shape, or pressure-adjustable valves, to vent gases from the gas expansion-compression zone at any desired rate. For example, the structure or size of the pressure relief port can be selected to allow escape of gases at the rate suitable for the particular payload and propellant. By decelerating the empty or emptying payload cartridge in this manner, felt recoil is further reduced.

In other aspects, safety mechanisms can be included that only allow a fresh, unfired payload cartridge to be fitted from the muzzle end of the launcher tube only when the firing action is open. In other aspects, the launcher can be accompanied by various accessories, such as a rod that can be kept with the device, for example accessible through a butt plate of the stock, that is designed to fit a hole in the baffle plate at the aft end of the launcher tube, such that the action can be broken open, and the expended payload cartridge hull can be push out from the breech end if necessary.

In one aspect, the propellant and the payload of the payload cartridge can be separated by an obturating component, such that a suitable gas seal is imposed on the expanding gases within the "chamber" of the payload cartridge. Suitable obturating components include the so-called "wadless" technology described in U.S. Pat. No. 7,814,820 and U.S. Patent Application Publication No. 2011/0017090 by Menefee, both of which are incorporated herein by reference in their entireties. While not intended to be limiting, wadless technology may be useful in launching powders, gels, and other materials in the disclosed cartridge launcher.

In another aspect, the payload launcher system can include any variety of safety systems, for example, a manual safety and/or a drop safety. Examples include simple button or crossbolt manual safeties, and/or drop safeties such as a hammer block, a transfer bar, a safety notch, a firing pin block, and the like. These features typically are components of the receiver and trigger assembly and are well known to the skilled artisan.

It is emphasized that the specific embodiment illustrated in the figures is merely illustrative and not intended to be limiting. For example, in one aspect, this disclosure provides a payload launcher system, in which the system can comprise:

a) a launcher tube having a muzzle, a breech comprising a propulsion blank chamber, and a barrel lug at the aft end; and b) a break action shotgun receiver pivotally attached to the launcher tube at the barrel lug and comprising a firing mechanism that mates with the breech;

the launcher tube further comprising:

i) a gas expansion-compression zone at the aft end of the launcher tube, ii) a pressure relief port providing a pressure conduit between the gas expansion-compression zone and the air outside the launcher tube, and iii) an elongated rocking firing pin situated in a longitudinal cut out in the side wall of the launcher tube, the rocking firing pin comprising:

1) a forward end that is pivotally attached to the side wall of the launcher tube within the cutout to allow movement of the rocking firing pin within the plane containing the launcher tube axis, the forward end comprising an extended lever that protrudes into the interior of the launcher tube; and 2) an unattached aft end that comprises a firing pin portion oriented to strike a primer in the center of the launcher tube;

and iv) optionally, at least one detent situated at the aft end of the launcher tube and extending into the interior thereof a sufficient distance to capture a cartridge rim, each detent retractably attached to the side wall of the launcher tube.

According to another aspect, this disclosure provides a method of using a payload launcher system, the method comprising:

a) providing a payload launcher system according to claim 1;

b) loading breech of the payload launcher system with a propulsion blank;

c) loading muzzle of the payload launcher system with a payload cartridge comprising the desired payload;

and d) activating the firing mechanism of the receiver to ignite the propulsion blank.

In accordance with another aspect of this disclosure, there is provided a method of launching a payload, which also provides a means of managing recoil, the method comprising:

a) providing a launcher tube having a muzzle, a breech comprising first stage propulsion device, a gas expansion-compression zone within the aft portion of the launcher tube in communication with the first stage propulsion device, the gas expansion-compression zone having a pressure relief means, and a movable firing mechanism located between the breech and the muzzle of the launcher tube which is activated by contact with a forward-moving object within the payload tube;

b) providing a payload cartridge having a size and shape for axial movement within the launcher tube; the payload cartridge comprising a primer, a second stage propellant, and a payload; and c) charging the payload cartridge into the launcher tube;

d) activating the first stage propellant device to impart forward movement of the payload cartridge through the launcher tube and provide momentum to the payload cartridge;

e) while the payload cartridge is in forward motion within the launcher tube, contacting a portion of the payload cartridge with the movable firing mechanism;

f) allowing the movable firing mechanism to contact the primer with sufficient force to activate the primer and launch the payload, thereby thrusting the payload cartridge rearward; and g) allowing the rearward-moving payload cartridge to recoil rearward against a gas cushion.

When the payload cartridge is activated by this launching sequence, recoil reduction is further assisted by the compression of gases in the gas expansion-compression zone 125 (FIG. 4A) that occurs when the cartridge case is thrust rearward after firing. Thus, a type of expansion-compression cycle is effected in which the gas expansion-compression zone 125 operates as both a gas "expansion" zone when firing the propulsion blank and a gas "compression" zone when firing the payload cartridge. The gas compression portion of the cycle provides a component of the recoil dampening of this system. Therefore, the method of launching a payload can further comprise overcoming the momentum of the forward-moving payload cartridge on firing the payload cartridge, and also can further comprise compressing gases in the so-call gas expansion-compression zone 125 at the aft end of the launcher tube. If desired, the aft end of the launcher tube can include gas vents to release the compression gases at a desired rate.

In a further aspect, and in contrast to the embodiment illustrated in FIG. 2, the payload cartridge of this disclosure can be provided with additional features or structures as desired, to take full advantage of its utility as a self-contained cartridge. For example, the cartridge hull and its fore end can provide the functions of a standard barrel from which a payload might conventionally be launched. In this exemplary aspect, the fore end of the payload cartridge could contain by way of an attached structure, could comprise, or could be made of, a material that forms a nozzle or "choke" upon launching, which can force a particular or desired pattern of the ejected payload upon launching. By way of example, the material used to construct the fore end portion of the cartridge could be selected according to thickness, stiffness, composition, crimp structure, and the like, such that it conforms to a desired nozzle shape when opened during launching.

In one aspect, the components of the launcher system including the launcher tube 10 of this disclosure can be fabricated from any suitable material that will resist the heat and pressure of launching, including any suitable plastic, metal, composite, polymer, or combination thereof. For lighter weight, a suitable plastic or composite material may be used. Even though the device is relatively light for carry by military troops, law enforcement and the like, and even though it is designed to launch a large payload, it is expected that there will be only moderate recoil when the device is launched, for the reasons described herein. Moreover, most payloads are expected to be launched with from about 50 fps (feet-per-second) muzzle velocities, to about 500 fps muzzle velocity; alternatively, from about 75 fps to about 400 fps; or alternatively from about 100 fps to about 300 fps.

In certain aspects, certain advantages of the disclosed launcher include the ability of this design to pack and contain reactive chemicals in a waterproof cartridge for safety. The launcher is specifically designed to deliver its payload at stand-off ranges, with extremely high reliability, using a system that does not require constant maintenance or recharges to maintain pressure. The disclosed system also does not require any additional reactive mass to launch, just the expanding gases in a two-stage propulsion and launching sequence. It is also expected that it will be possible to prevent, contain, or minimize injury to personnel through the use of chemical payloads such as fire suppression chemicals, anti-chemical warfare substances, or anti-biological warfare substances, including situations in which certain payloads may be launched directly at personnel with the intent to cover the individual with the chemical payload.

Also by way of example, the present launcher system can be used to deliver any number of payload types, including but not limited to, rubber projectile payload, a bean bag payload, frangible payload, a tear gas-containing payload, an oleoresin capsicum-containing payload, a liquid-containing payload, a powder-containing payload, a gel-containing payload, a marking payload, a tracer payload, an incendiary payload, a flare payload, a chemical or chemical-containing payload, a biological or biological-containing payload, or any combination thereof.

Generally, the disclosed launcher does not fall under the definitions of "destructive device" as set forth in either Title I (the Gun Control Act of 1968) or Title II (the National Firearms Act of 1934) of the Federal firearms laws. In this aspect, the launcher devices cannot be used or fired with any known ammunition. Rather, propulsion blanks and payload cartridges must be specifically manufactured for use in these launcher systems, typically using a proprietary or non-standard size. The types of payloads and cartridges that the launcher is designed to handle are not anti-personnel payloads, but rather those designed for saving lives and property, such as various chemical payloads. For example, the launcher systems of this disclosure can be used to launch cartridges that contain payloads such as dry chemicals, gels, and the like, examples of which include fire suppression chemicals, anti-chemical warfare substances that can counteract chemical warfare agents, or anti-biological warfare substances that can counteract biological warfare agents.

While not generally intended for such uses, if desired, the present launcher system can be adapted to launch other payloads that may constitute classifying the device as a "destructive device", such as a non-frangible payload, a penetrator payload, a flechette payload, an armor-piercing payload, an explosive payload, and the like. Therefore, the present devices could be adapted for use with a grenade launcher cartridge, an explosive-launching cartridge, an armor-piercing cartridge, or anti-personnel cartridges.

To define more clearly the terms used herein, the following definitions are provided, which are applicable to this disclosure unless otherwise indicated by the disclosure or the context. To the extent that any definition or usage provided by any document incorporated herein by reference conflicts with the definition or usage provided herein, the definition or usage provided herein controls.

Reference to the muzzle end, forward end, or fore end of a particular launcher, component, or cartridge means the end that is further downrange when the component or cartridge is in its intended orientation for firing. The fore end may also be termed the leading end or leading edge, the top, the downrange end, or the distal end, and these terms are used interchangeably.

Reference to the rearward or rear end of a particular launcher, component, or cartridge means the end that is further uprange when the component or cartridge is in its intended orientation for firing. The rear end may also be termed trailing end or trailing edge, the aft portion or aft end, the bottom, the uprange end, the proximal end, or the primer end, and these terms are used interchangeably. The rearward or aft end of the launcher tube also may be termed the breech or the breech end.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims, the word "comprise" and variations of the word, such as "comprising" and "comprises," means "including but not limited to," and is not intended to exclude, for example, other additives, components, elements, or steps. While structures, compositions, and methods are described in terms of "comprising" various components or steps, the structures, compositions, and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed herein, and that each value is also herein disclosed as "about" that particular value in addition to the value itself.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A launcher system comprising:

a) a launcher tube having a muzzle and a breech and comprising a propulsion blank chamber at the breech;

b) a receiver attached to the launcher tube comprising a firing mechanism that mates with the propulsion blank chamber;

c) a primer-activated cartridge sized for axial movement within the launcher tube, the cartridge comprising a case, a primer, a propellant, and a payload;

d) a gas expansion-compression zone at the breech end of the launcher tube, in communication with the propulsion blank chamber;

e) a pressure relief means to vent gas from the gas expansion-compression zone; and f) a primer activating means for activating the primer when the cartridge is moved a selected distance from breech to muzzle in the launcher tube.

2. A launcher system according to claim 1, wherein the primer activating means is a firing pin or an electronic primer system.

3. A launcher system according to claim 1, wherein the primer activating means is an elongated rocking firing pin situated in a longitudinal cutout in the side wall of the launcher tube, the rocking firing pin comprising:

a) a forward end that is pivotally attached to the side wall of the launcher tube within the cutout to allow movement of the rocking firing pin within the plane containing the launcher tube axis, the forward end comprising an extended lever that protrudes into the interior of the launcher tube; and b) an unattached aft end that comprises a firing pin portion oriented to strike a primer in the center of the launcher tube.

4. A launcher system according to claim 1, wherein the cartridge further comprises a rim.

5. A launcher system according to claim 1, wherein the cartridge further comprises a rim, and the launcher tube further comprises at least one detent situated at the breech end and extending into the interior thereof a sufficient distance to detachably secure the cartridge rim.

6. A launcher system according to claim 5, wherein each detent is retractably attached to the side wall of the launcher tube.

7. A launcher system according to claim 1, wherein the primer activating means is an electronic primer system and the cartridge further comprises an electrically-conductive rim.

8. A launcher system according to claim 1, wherein the pressure relief means comprises a pressure conduit, a pressure relief valve, or a combination thereof.

9. A launcher system according to claim 1, wherein the receiver is a shotgun style receiver.

10. A launcher system according to claim 1, wherein the receiver is a shotgun style receiver comprising a stock for shoulder mounting.

11. A launcher system according to claim 1, wherein the receiver is a shotgun style receiver comprising a pistol grip.

12. A launcher system according to claim 1, wherein the receiver is a break action shotgun style receiver.

13. A launcher system according to claim 12, wherein the launcher tube further comprises a barrel lug at the aft end and the receiver comprises a hinge pin adapted to mate with the barrel lug.

14. A launcher system according to claim 1, wherein the receiver further comprises a manual safety.

15. A launcher system according to claim 1, wherein the payload is selected from chemical, powder, gel, fire suppression, pyrotechnic, marker, tracer, signaling, non-lethal projectile, frangible, anti-personnel, explosive, smoke, incendiary, biological, heat insulating, anti-chemical warfare, anti-biological warfare, liquid-containing, powder-containing, and gel-containing.

16. A launcher system according to claim 1, wherein the primer-activated cartridge is selected from a flare cartridge, a smoke cartridge, a smoke flare cartridge, a signaling device cartridge, an illumination cartridge, a chemical cartridge, a biological cartridge, a distraction device cartridge, a pyrotechnic cartridge, an anti-personnel cartridge, a marking cartridge, an incendiary cartridge, a tracer cartridge, a non-lethal projectile cartridge, an anti-chemical warfare cartridge, or anti-biological warfare cartridge.

17. A launcher system according to claim 1, wherein the primer-activated cartridge further comprises an obturating medium between the propellant and the payload.

18. A launcher system according to claim 17, wherein the primer-activated cartridge does not comprise a pre-shaped gas seal.

19. A launcher system according to claim 17, wherein the primer-activated cartridge is a non-standard ammunition cartridge size.

20. A method of attenuating recoil when firing a primer activated cartridge, the method comprising:

a) providing a launcher system according to claim 1;

b) loading the propulsion blank chamber with a propulsion blank comprising a first stage propellant;

c) activating the propulsion blank to impart forward movement to the payload cartridge within the launcher tube from the expanding first stage propellant gases within the gas expansion-compression zone;

d) while the payload cartridge is in forward motion, activating the cartridge primer and the cartridge propellant, imparting rearward movement to the cartridge case; and e) selecting or adjusting the pressure relief means to vent gas from the gas expansion-compression zone at a rate that reduces felt recoil.

21. A method of attenuating recoil according to claim 20, wherein the pressure relief means comprises a pressure conduit that is selected or adjusted according to size and shape to vent gas from the gas expansion-compression zone at a rate that reduces felt recoil.

22. A method of attenuating recoil according to claim 20, wherein the pressure relief means comprises a pressure relief valve that is selected or adjusted according to pressure and size to vent gas from the gas expansion-compression zone at a rate that reduces felt recoil.

23. A method of attenuating recoil according to claim 20, wherein the cartridge primer activating means is a firing pin or an electronic primer system.

24. A method of attenuating recoil when firing a primer activated cartridge, the method comprising:

a) providing a launcher system according to claim 1; and b) activating the primer and the propellant while the primer activated cartridge is in forward motion.

25. A method of attenuating recoil when firing a primer activated cartridge, the method comprising:

a) providing a primer activated cartridge comprising a primer, a propellant, and a payload; and b) activating the primer and the propellant while the primer activated cartridge is in forward motion.

* * * * *